US007807592B2

(12) United States Patent
Bland et al.

(10) Patent No.: US 7,807,592 B2
(45) **Date of Patent: *Oct. 5, 2010**

(54) INTERIOR WALLBOARD AND METHOD OF MAKING SAME

(75) Inventors: Brian W. Bland, Social Circle, GA (US); Alan E. Currier, Atlanta, GA (US)

(73) Assignee: Georgia-Pacific Gypsum LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/607,703

(22) Filed: Oct. 28, 2009

(65) Prior Publication Data

US 2010/0048080 A1 Feb. 25, 2010

Related U.S. Application Data

(63) Continuation of application No. 11/113,330, filed on Apr. 25, 2005, now Pat. No. 7,635,657.

(51) Int. Cl.

| | |
|---|---|
| ***B32B 13/14*** | (2006.01) |
| ***B32B 13/02*** | (2006.01) |
| ***B32B 13/04*** | (2006.01) |
| ***B32B 17/06*** | (2006.01) |

(52) U.S. Cl. ..... 442/386; 442/381; 442/348; 442/180; 428/294.7

(58) Field of Classification Search ..... 442/386, 442/381, 348, 180; 428/294.7

See application file for complete search history.

(56) References Cited

U.S. PATENT DOCUMENTS 1,844,084 A * 2/1932 Weber ..... 427/270

(Continued)

FOREIGN PATENT DOCUMENTS

CA 993779 A1 7/1976

(Continued)

OTHER PUBLICATIONS

Rouette, Hans-Karl Encyclopedia of Textile Finishing (pp. 67-79 & 140). Woodhead Publishing, 2001. Online version available at http://www.knovel.com/knovel2/Toc.jsp?BookID=1225&VerticalID=0.

(Continued)

*Primary Examiner*—Cheryl Juska
(74) *Attorney, Agent, or Firm*—Joel T. Charlton

(57) ABSTRACT

A gypsum wallboard suitable for Level 4 finishing having a coated non-woven first glass fiber mat facing material on one major surface and an optionally coated second glass fiber mat where on the other major surface. The first glass fiber mat has a majority of fibers of a nominal fiber diameter between 8 and 11 microns and a fiber length between ¼ and ¾ inch and has a basis weight between about 1.7 lb./100 ft.$^2$ and about 2.0 lb./100; the second glass fiber mat has a majority of fibers of a nominal fiber diameter of at least 13 microns but no greater than about 16 microns and a fiber length between ¾ and 1 inch and has a basis weight between about 1.8 lb./100 ft.$^2$ and about 2.2 lb./100, and wherein the fibers in both of the non-woven glass fiber mats are bound together with an acrylic-type adhesive binder.

19 Claims, 2 Drawing Sheets

U.S. PATENT DOCUMENTS

| | | | |
|---|---|---|---|
| 2,906,660 | A | 9/1959 | Hungerford et al. |
| 3,012,929 | A | 12/1961 | Jackson |
| 3,050,427 | A | 8/1962 | Slayter et al. |
| 3,103,461 | A | 9/1963 | Smith et al. |
| 3,228,825 | A | 1/1966 | Waggoner |
| 3,455,710 | A | 7/1969 | Nitzsche et al. |
| 3,516,882 | A | 6/1970 | Cummisford |
| 3,623,895 | A | 11/1971 | Nitzsche et al. |
| 3,760,458 | A | 9/1973 | Pitt |
| 3,766,003 | A | 10/1973 | Schuller et al. |
| 3,824,147 | A | 7/1974 | Baird |
| 3,838,995 | A | 10/1974 | Smith |
| 3,905,067 | A | 9/1975 | Keib et al. |
| 3,935,021 | A | 1/1976 | Greve et al. |
| 3,945,965 | A | 3/1976 | Ramig, Jr. et al. |
| 3,947,398 | A | 3/1976 | Williams |
| 3,993,822 | A | 11/1976 | Knauf et al. |
| 4,067,939 | A | 1/1978 | Lowe et al. |
| 4,073,997 | A | 2/1978 | Richards et al. |
| 4,112,174 | A | 9/1978 | Hannes et al. |
| 4,129,674 | A | 12/1978 | Hannes et al. |
| 4,136,687 | A | 1/1979 | Dabroski |
| 4,233,353 | A | 11/1980 | Bondoc et al. |
| 4,265,979 | A | 5/1981 | Baehr et al. |
| 4,303,722 | A | 12/1981 | Pilgrim |
| 4,378,405 | A | 3/1983 | Pilgrim |
| 4,394,414 | A | 7/1983 | Brown et al. |
| 4,447,498 | A | 5/1984 | Fink |
| 4,477,300 | A | 10/1984 | Pilgrim |
| 4,494,990 | A | 1/1985 | Harris |
| 4,504,533 | A | 3/1985 | Altenhofer et al. |
| 4,572,861 | A | 2/1986 | Barretto Garcia et al. |
| 4,631,097 | A | 12/1986 | Kossuth |
| 4,637,951 | A | 1/1987 | Gill et al. |
| 4,643,771 | A | 2/1987 | Steinbach et al. |
| 4,647,496 | A | 3/1987 | Lehnert et al. |
| 4,681,802 | A | 7/1987 | Gaa et al. |
| 4,784,897 | A | 11/1988 | Brands et al. |
| 4,810,576 | A | 3/1989 | Gaa et al. |
| 4,876,142 | A | 10/1989 | Piccirillo |
| 4,879,173 | A | 11/1989 | Randall |
| 4,916,004 | A | 4/1990 | Ensminger et al. |
| 4,948,647 | A | 8/1990 | Burkard |
| 5,001,005 | A | 3/1991 | Blanpied |
| 5,102,728 | A | 4/1992 | Gay et al. |
| 5,112,678 | A | 5/1992 | Gay et al. |
| 5,135,805 | A | 8/1992 | Sellers et al. |
| 5,256,222 | A | 10/1993 | Shepherd et al. |
| 5,308,692 | A | 5/1994 | Kennedy et al. |
| 5,342,680 | A | 8/1994 | Randall |
| 5,389,716 | A | 2/1995 | Graves |
| 5,395,685 | A | 3/1995 | Seth et al. |
| 5,397,631 | A | 3/1995 | Green et al. |
| 5,484,653 | A | 1/1996 | Kennedy et al. |
| 5,514,744 | A | 5/1996 | Brown |
| 5,552,187 | A | 9/1996 | Green et al. |
| 5,718,785 | A | 2/1998 | Randall |
| 5,772,846 | A | 6/1998 | Jaffee |
| 5,883,021 | A | 3/1999 | Beer et al. |
| 5,883,024 | A | 3/1999 | Currier et al. |
| 5,965,257 | A | 10/1999 | Ahluwalia |
| 5,981,406 | A | 11/1999 | Randall |
| 6,001,496 | A | 12/1999 | O'Haver-Smith |
| 6,221,521 | B1 | 4/2001 | Lynn et al. |
| 6,365,533 | B1 | 4/2002 | Horner, Jr. et al. |
| 6,387,172 | B1 | 5/2002 | Yu et al. |
| 6,391,131 | B1 | 5/2002 | Newman et al. |
| 6,524,679 | B2 | 2/2003 | Hauber et al. |
| 6,703,331 | B1 | 3/2004 | Bruce et al. |
| 6,723,670 | B2 | 4/2004 | Kajander et al. |
| 6,737,156 | B2 | 5/2004 | Koval et al. |
| 6,770,354 | B2 | 8/2004 | Randall et al. |
| 6,808,793 | B2 | 10/2004 | Randall et al. |
| 7,049,251 | B2 * | 5/2006 | Porter ..... 442/79 |
| 7,300,515 | B2 * | 11/2007 | Porter ..... 106/770 |
| 7,300,892 | B2 * | 11/2007 | Porter ..... 442/79 |
| 2002/0155282 | A1 | 10/2002 | Randall et al. |
| 2002/0187298 | A1 | 12/2002 | Hauber et al. |
| 2003/0134079 | A1 | 7/2003 | Bush et al. |
| 2003/0175478 | A1 | 9/2003 | Leclercq |
| 2003/0203191 | A1 | 10/2003 | Randall et al. |
| 2003/0211305 | A1 | 11/2003 | Koval et al. |
| 2004/0170873 | A1 | 9/2004 | Smith |
| 2004/0209071 | A1 | 10/2004 | Carbo et al. |
| 2004/0209074 | A1 | 10/2004 | Randall et al. |
| 2004/0266303 | A1 | 12/2004 | Jaffee |
| 2004/0266304 | A1 | 12/2004 | Jaffee |
| 2005/0103262 | A1 | 5/2005 | Bush et al. |
| 2005/0202742 | A1 | 9/2005 | Smith et al. |
| 2005/0266225 | A1 | 12/2005 | Currier et al. |
| 2006/0240236 | A1 | 10/2006 | Bland et al. |
| 2007/0026185 | A1 | 2/2007 | Fay et al. |
| 2007/0141931 | A1 | 6/2007 | Nandi et al. |
| 2008/0003903 | A1 | 1/2008 | Nandi |
| 2008/0176050 | A1 | 7/2008 | Lintz et al. |
| 2008/0261041 | A1 * | 10/2008 | Thomas et al. ..... 428/359 |
| 2009/0029141 | A1 * | 1/2009 | Shake et al. ..... 428/293.4 |
| 2009/0084514 | A1 | 4/2009 | Smith et al. |
| 2009/0087616 | A1 | 4/2009 | Hennis et al. |
| 2009/0163097 | A1 | 6/2009 | Kajander |
| 2009/0173423 | A1 | 7/2009 | Jaffee |
| 2009/0186549 | A1 | 7/2009 | Bennett |
| 2009/0208714 | A1 | 8/2009 | Currier |

FOREIGN PATENT DOCUMENTS

| | | | |
|---|---|---|---|
| DE | 2808723 | A1 | 9/1979 |
| DE | 3508933 | A1 | 10/1986 |
| EP | 0154094 | A2 | 11/1985 |
| GB | 1250713 | A | 10/1971 |
| GB | 2022503 | A | 12/1979 |
| GB | 2023687 | A | 1/1980 |
| GB | 2097837 | A | 11/1982 |
| JP | 2001020445 | A | 1/2001 |

OTHER PUBLICATIONS

PCT/US2006/014663 International Search Report mailed Sep. 8, 2006.

PCT/US04/32301 International Search Report mailed Apr. 13, 2005.

Dialog Printout for DE 3508933.

Gypsum Association Pamphlet—Matrix Edition: Recommended Levels of Gypsum Board Finish. GA-214-M-97. (Publication Date Unknown).

Gypsum Association Pamphlet—Recommended Levels of Gypsum Board Finish. GA-214-96. (Publication Date Unknown).

Georgia-Pacific DensArmor Plus Paperless Interior Drywall; 2007 Georgia-Pacific Gypsum LLC Lit Item # 531259; www.densamorplus.com.

Georgia-Pacific DensShield Tile Backer; 2006 Georgia Pacific Gypsum Corporation; Lit Item # 101515; www.densshield.com.

Georgia-Pacific DensDeck Roof Board; 2006 G-P Gypsum Corporation; Lit. Item 101516; www.densdeck.com.

* cited by examiner (not to scale)

(not to scale)

INTERIOR WALLBOARD AND METHOD OF MAKING SAME

CROSS-REFERENCE TO RELATED APPLICATIONS

This application is a continuation application of U.S. Ser. No. 11/113,330 filed Apr. 25, 2005, now U.S. Pat. No. 7,635,657 the entire contents of which are incorporated by reference herein.

FIELD OF THE INVENTION

This invention relates to an improved gypsum wallboard faced on both major surfaces with glass fiber mats. More particularly, the present invention relates to a gypsum wallboard suitable for internal use covered on one major surface with a coated glass mat of a first basis weight made from glass fibers of a specified diameter and length such that the mat has a surface suitable for Level 4 finishing (GA-214-96) and covered on its other major surface with an optionally coated glass fiber mat having a second, generally higher basis weight and made from glass fibers of a larger diameter and of a longer length than the fibers of the coated glass mat, such that the board has acceptable flexural strength properties.

BACKGROUND OF THE INVENTION

The building industry widely uses gypsum wallboard, consisting of a core of set gypsum sandwiched between two sheets of multi-ply paper facing material in the construction of residential homes, commercial buildings, and other structures. The use of paper-faced gypsum wallboard has become one of the most common means of finishing the interior structure of buildings. Paper-faced gypsum wallboard, also known as drywall, is usually manufactured (pre-cut) in flat sheets of 4 ft. by 8ft., or 4 ft. by 12 ft., typically having a thickness of ½" or ⅝". The sheets of the paper-faced gypsum wallboard are hung on wood or metal studs to foini the interior partitions or walls of rooms, elevator shafts, stairwells, ceilings and the like.

Conventional paper-faced gypsum wallboard is typically manufactured from a slurry of stucco (calcined gypsum slurry, gypsum hemi-hydrate sly) wherein the slurry is placed between two layers of multi-ply paper facers and the slurry is allowed to set. In typical paper-faced gypsum wallboard, the two layers of multi-ply paper facers contain/restrain the slurry while it sets and provide the flexural strength required in installation and use. Be set gypsum is a hard and rigid product obtained when the calcined gypsum reacts with water to form calcium sulfate dihydrate.

During wallboard production, water in excess of that needed to hydrate the calcined gypsum must be removed from the slurry during the curing. While a certain amount of water is required to hydrate the calcined gypsum, excess water is added, e.g., on the order of two, or more times than that actually needed to hydrate the calcined gypsum, in order to obtain a smooth, free-flowing slurry suitable for transporting and then depositing on the lower facing sheet to form the board core. This excess water must be evaporated primarily through the facing sheets as the board is cured and dried.

Gypsum wallboard is typically made as a continuous product on an endless conveyor using rolls of the paper facing material. The board is cut into discrete lengths to accommodate subsequent handling and then dried in heated dryers until the discrete boards are completely dry. The quality of the paper facers determines the kind of applications suitable for using the boards and the surface treatments that may be used on the boards.

The paper facers usually employed in the production of paper-faced gypsum wallboards generally consist of two types. The facer used on the side of the wallboard intended to face the interior of a room is of a multi-ply construction with the outer plies usually composed of a better grade of paper. This allows the smooth surface board to be finished in a variety of aesthetically acceptable ways, especially by painting. The inner plies, including the one that contacts with the board core is usually made of repulped newsprint and recycled corrugated boxes. The paper facer used on the backside of the board destined for placement against the studs is usually made of a plurality of plies of the lower grade of paper, e.g., the repulped newsprint and corrugated boxes.

Multi-ply paper facings have long been used because they provide a unique combination of properties. Paper is able to form a satisfactory bond with the set gypsum, particularly gypsum with added binder, e.g., starch, so that the facing is not easily delaminated from the set gypsum core. As noted above, water that is added to prepare the gypsum slurry and that does not chemically combine with the stucco (calcined gypsum) must evaporate mainly through any facing sheets without causing delamination. Paper is sufficiently porous to allow the water vapor to permeate through it during gypsum wallboard manufacture. Paper also presents a smooth surface that can easily be finished in a number of ways, such as by application of wallpaper or especially by painting, with minimal surface preparation.

Although paper is a relatively inexpensive facing material and is easily used in the process of manufacturing wallboard, it has disadvantages, particularly with regard to moisture-resistance. Moisture can have deleterious effects upon paper-faced wallboard. In addition to degrading strength and other structural properties, moisture (in combination with other factors) can encourage the growth of fungi (including, e.g., mold). The problem can (under certain circumstances) be particularly acute with regard to certain spaces that, upon installation of the wallboard, are enclosed and inaccessible.

As an alternative to paper facing, gypsum wallboard can also be manufactured with a fibrous mat (such as a mat of glass fibers) as a facing material. Examples of such wallboards include those described in, e.g., U.S. Pat. Nos. 3,993,822, 5,644,880, 5,791,109, 5,883,024 and 6,001,496. In addition to improved water resistance, fibrous matting, and especially glass fiber matting may provide significant improvements in strength and other desired structural attributes.

U.S. patent application Ser. No. 10/957,745 (incorporated herein by reference) describes a recent advancement in gypsum wallboard technology for interior applications. According to this patent application, at least one major surface of the gypsum wallboard is faced with a unique, coated non-woven glass mat suitable for producing, in the resulting glass mat-faced gypsum board, a surface suitable for Level 4 finishing in the same manner as commercially available multi-ply paper-faced gypsum wallboard, i.e., a very smooth surface.

This result is achieved by using, as a facer material for making gypsum wallboard, a coated non-woven, glass fiber mat which comprises, and which preferably consists essentially of, fibers having a diameter of no greater than about 11 microns, and preferably no less than about 8 microns and having a length between ¼ and ¾ inch, that are bound together predominantly with an acrylic binder having a suitable softness. The coating on the glass mat is prepared by drying an aqueous mixture of (i) a mineral pigment, (ii) a polymer adhesive binder (also preferably an acrylic binder) and optionally (iii) an inorganic adhesive binder. Preferably, the coating is applied to the glass mat before the glass mat is used to make the gypsum wallboard. Such mat is referred to as pre-coated mat.

During the initial development of this product, the actual coated glass mat facer material used on the interior (smooth) face was made using a blend of 75% by weight ¼ inch long and 25% by weight ¾ inch long and nominal 10-11 micron diameter glass fibers (H fibers) which were bound together with an acrylic binder. This glass mat had a basis weight (before application of the coating) of about 1.4 pounds per 100 square feet. The opposite surface of the gypsum board was also faced with a glass mat. The glass mat used on this opposite surface was also a coated glass mat having a basis weight (before application of the coating) of about 1.4 pounds per 100 square feet. The glass mat for the opposite surface was made using predominately ¾ inch long glass fibers having a nominal diameter of about 13 microns (K fibers) that were bound together predominantly with a urea-formaldehyde binder.

Two problems that were encountered during the development of this interior gypsum board product were (1) an unexpected warping of the boards made with the above-noted glass mats on the two major faces (the warping developed mainly as the boards passed through the oven drier) and (2) an inability to consistently produce finished boards having an acceptable flexural strength.

The problem with board warping was particularly prevalent when longer boards, e.g., 4 ft. by 12 ft boards, having a thickness of ⅝ inch, were produced. The warping manifested itself in a bowing of the board in the machine direction (MD). In the case of the ⅝ boards, the warping was so severe that the conventional practice of end taping the boards, such that the interior surfaces of two boards are stacked face-to-face, could not be done without damaging the boards.

Based on additional development, it was determined that the configuration of the present invention was able to provide in a consistent manner a non-warping, interior gypsum wallboard product of a desired flexural strength and having glass mat facers on both major surfaces, one of which is a pre-coated mat having a smooth face suitable for Level 4 finishing (GA-214-96).

BRIEF DESCRIPTION OF THE DRAWINGS

The features and advantages of the invention will be apparent from the following more detailed description of certain embodiments of the invention and as illustrated in the accompanying drawings in which reference characters refer to the same parts throughout the various views. The drawings are not to scale, emphasis instead being placed upon illustrating the features of the invention.

DETAILED DESCRIPTION OF THE INVENTION

Figure 1:
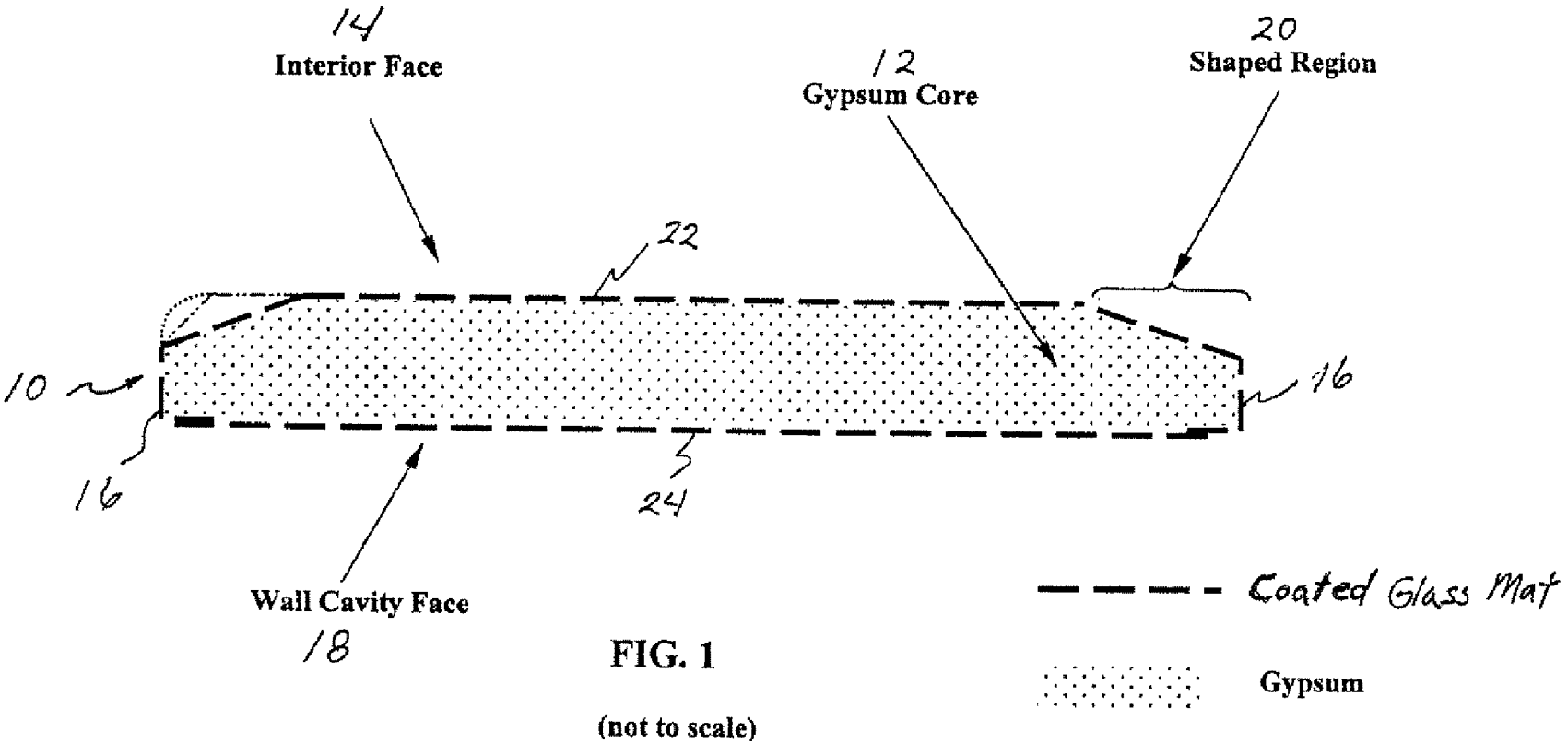
FIG. 1 is a highly schematic cross section of a coated glass mat faced wallboard according to the present invention.

According to the present invention, a gypsum wallboard suitable for finishing the interior spaces of residential homes, commercial buildings, and other structures is faced on both major surfaces with non-woven glass fiber mats.

One of the major surfaces of the gypsum wallboard, i.e., the surface intended to face the interior space of a room, is faced with a coated nonwoven glass mat suitable for Level 4 finishing, a level of smoothness comparable to commercially available multi-ply paper-faced gypsum wallboard, i.e., a facer with a very smooth surface (i.e., the first mat). This result is achieved by using, as a facer material for making the gypsum wallboard, a coated non-woven, glass fiber mat which comprises, and which preferably consists essentially of, fibers having a nominal diameter of no greater than about 11 microns, and preferably no less than about 8 microns which are bound together with an acrylic-type binder having a suitable softness. The fibers constituting the coated glass mat also have a fiber length between ¼ and ¾ inch and the coated non-woven glass fiber facing material has a basis weight of between about 1.7 and 2.0 pounds per 100 square feet before application of the coating.

According to the present invention, the other major surface of the gypsum wallboard, i.e., the surface intended to face the supporting studs, is faced with an optionally coated non-woven glass mat made from glass fibers having a nominal diameter of at least about 13 microns, but no greater than about 16 microns, which also are bound together with an acrylic-type binder (i.e., the second mat). The fibers constituting the optionally coated glass mat also have a fiber length of at least about ¾ inch and generally no greater than about 1 inch, and the optionally coated non-woven glass fiber facing material has a basis weight (before application of any coating) between about 1.8 and 2.2 pounds per 100 square feet, preferably at least 1.9 pounds per 100 square feet and usually greater than the basis weight of said coated non-woven glass mat facing material (the first mat) before application of its coating. Preferably, the basis weight of the second mat is at least about 0.5 pounds per 100 square feet, and more usually at least about 0.15 pounds per 100 square feet, greater than the non-coated basis weight of said coated non-woven glass mat facing material (the first mat).

As used herein, the term "nominal diameter" refers to the minimum thickness of fibers that may not have a substantially circular cross section and is intended to embrace fibers having a normal distribution of thicknesses about a mean.

The various levels of finishing gypsum board is described in Publication GA-214-96, Recommended Levels of Gypsum Board Finish available from Gypsum Associates, Washington, D.C., incorporated herein by reference in its entirety. Level 4 finishing is typically specified when flat paints, light textures or wall coverings are to be applied to the board surface. Thus, such a surface must be suitably smooth such that such wall finishes can be applied with minimal preparation and be aesthetically acceptable.

Non-woven glass mat suitable for use in the present invention on both major surfaces of the gypsum board can be prepared by a wet-laid process, which is carried out on what can be viewed as modified papermaking machinery. Descriptions of the wet-laid process for making glass mats may be found in a number of U.S. patents, including U.S. Pat. Nos. 2,906,660, 3,012,929, 3,050,427, 3,103,461, 3,228,825, 3,760,458, 3,766,003, 3,838,995, 3,905,067, 4,112,174, 4,129,674, 4,681,802 and 4,810,576, all of which are incorporated herein by reference. The method of making the non-woven glass mats forms no part of the present invention.

In general, the wet-laid process for making non-woven glass fiber mats comprises first forming an aqueous slurry of short-length glass fibers (referred to in the art as "white water") under agitation in a mixing tank, then feeding the slurry onto a moving screen on which the fibers enmesh themselves into a freshly prepared wet glass fiber mat, while excess water is separated from the mat of fibers.

Machines such as wire cylinders, Fourdrinier machines, Stevens Former, Hydroformer, Roto Former, Deltaformer, Inver Former and Venti Former machines and the like can be used to form the wet-laid mat. In such equipment, a head box deposits the slurry onto a moving wire screen. Suction or vacuum removes the water resulting in the wet-laid mat.

Because glass fibers generally do not disperse well in water, it has been the industry practice to provide suspending aids for the glass fibers. Such suspending aids or dispersants usually are materials that increase the viscosity of the aqueous medium, Suitable dispersants conventionally employed in the art include polyacrylamides, hydroxyethyl cellulose, ethoxylated amines and amine oxides. Other additives such as surfactants, lubricants and defoamers also conventionally have been added to the white water. Such agents, for example, further aid the wettability and dispersion of the glass fibers.

The fiber slurry deposited on the moving screen or cylinder is processed into a sheet-like non-woven fiber mat by the removal of water, usually by suction and/or vacuum devices, and typically is followed by the application of an adhesive binder to the mat. The adhesive binder composition is usually an aqueous-based fluid and is impregnated directly into the fibrous mat and set or cured immediately thereafter to provide the desired mat integrity.

The present invention depends upon the use of an acrylic-type binder in the glass mats used on both major faces of the gypsum board. Aside from the binder, however, the actual construction of each of the mats themselves is different.

In the case of the non-woven mat which is adhered to the major surface of the gypsum core intended to face the interior space of a room (the first mat), the mat is prepared using glass fibers having a nominal diameter, preferably of not less than about 8 microns and not greater than about 11 microns. The glass fibers can be E, C, T or S fibers or any known type of glass fiber of good strength and durability. Preferably, a major proportion of the fibers, more preferably at least about 75 weight percent (wt. %) of the fibers and even more preferably essentially all of the fibers (i.e. consisting essentially of) have a nominal diameter of not less than about 8 microns and not greater than about 11 microns. Additionally, it is preferred that there are essentially no fibers in the non-woven first mat having a nominal diameter of greater than about 13 microns (i.e., no fibers larger than K fibers). For example, the first mat can be made from a blend of H and K fibers provided that there is a larger weight percentage of the H fibers, such as 75 wt. percent H fibers and 25 wt. % K fibers, or the first mat can be made primarily from fibers having a nominal diameter of about 10 to 11 microns (i.e., greater than 95 wt. % of the fibers have a nominal diameter of about 10 to 11 microns (i.e., 95 wt. % H fibers)).

The use of mats prepared from glass fibers having a nominal diameter of less than about 8 microns is undesirable because it is believed that the peel-strength, bonding ability and possibly the porosity of such mats (particularly after a coating is applied) precludes the preparation of acceptable gypsum wallboard. On the other hand, applicant expects that the use of mats prepared with too many fibers having a nominal fiber diameter greater than about 11 microns will result in a non-woven mat, even after application of the coating as described below, that has a surface morphology that cannot be finished in an acceptable fashion, i.e., the surface is not smooth enough to be directly amenable to Level 4 finishing techniques as described above. Suitable fibers of the appropriate diameter for making a glass mat suitable for use in the present invention can be obtained, for instance, from Johns Manville and Owens-Corning.

Most, if not all of the fibers used to make the first mat also should have a length somewhere between about one-quarter (¼) to about three-quarter (¾) inch, and more preferably from about one-quarter (¼) to about one-half (½) inch. Shorter fibers make formation of the mat more difficult; while too high of a proportion of longer fibers interferes with the preparation of a mat of a suitable surface morphology (smoothness) for level 4 finishing. Preferably, at least about 75 wt % of the fibers used to prepare the mat have a length between about one-quarter (¼) to about three-quarter (¾) inch and preferably between about one-quarter (¼) to about one-half (½) inch and more preferably at least about 90 wt % of the fibers used to prepare the mat have a length between about one-quarter (¼) to about three-quarter (¾) inch and preferably between about one-quarter (¼) to about one-half (½) inch. For example, a mat prepared using 75% by weight ¼ inch H fibers (about 10 to 11 microns in nominal diameter) and 25% by weight ¾ inch H fibers has been observed to have a suitable surface smoothness.

In addition to the nominal fiber diameter and fiber length, the weight per unit surface area at which the non-woven first glass fiber mat is prepared also influences surface properties (e.g., smoothness) and especially performance of the board made from the mat and thus determines the suitability of the mat for use in making a gypsum wallboard of the present invention. More specifically, it is preferred that the non-woven glass fiber mat (the first mat) be prepared at a weight per unit surface area (hereinafter also referred to as the basis weight) of at least about 1.7 lb/100 ft.$^2$ but no greater than about 2.0 lb/100 ft$^2$ and at an uncompressed mat thickness in the range of about 25 to about 40 mils, with a thickness of about 33 mils being the most typical. A basis weight of about 1.8 lb/100 ft.$^2$ to about 1.9 lb/100 ft.$^2$ is preferred and a basis weight of about 1.8 lb/100 ft.$^2$ has been shown to be suitable.

According to an especially preferred embodiment of the present invention, the non-woven fibrous mat used in making gypsum wallboard in accordance with the present invention consists essentially of a substantially random distribution of fibers having a nominal diameter of about 10 to 11 microns (and not less than 8 microns) (preferably at least 90 wt. percent of the fibers have a diameter of about 10-11 microns) and at least 75 wt percent of the fibers have a length between about ¼ and about ¾ inch, preferably a length between about ¼ and about ½ inch (preferably at least 90 wt. percent of the fibers have a length between about ¼ and about ¾ inch and preferably between about ¼ and about ½ inch) and the mat has a basis weight of about 1.8 lb./100 sq. ft. As shown in the Example which follows, a mat made from 75% by weight ¼ inch H fibers and 25% by weight ¾ inch H fibers at a basis weight of about 1.8 lb/100 sq. ft. is especially suitable.

The optionally coated non-woven mat which is adhered to the other major surface of the gypsum core intended to face the studs of a room (the second mat), is prepared using glass fibers having a nominal diameter of at least about 13 microns (K fibers) but generally not higher than about 16 microns (M fibers). Again, the glass fibers can be E, C, T or S fibers or any known type of glass fiber of good strength and durability. Preferably, a major proportion of the fibers, more preferably at least about 75 wt % of the fibers and even more preferably essentially all of the fibers (i.e. consisting essentially of) have a nominal diameter of at least about 13 microns. Again, it is generally preferred that there are essentially no fibers in the non-woven second mat having a nominal diameter of greater than about 16 microns.

As with the first mat, in addition to the nominal fiber diameter and fiber length, the weight per unit surface area at which the optionally coated non-woven glass fiber second mat is prepared also influences the performance of the board made from the mat. In accordance with the present invention, the non-woven glass fiber mat (the second mat) has a weight per unit surface area, (hereinafter also referred to as the basis weight and measured before the mat is provided with it optional coating), about 1.8 and 2.2 pounds per 100 square feet, preferably at least 1.9 pounds per 100 square feet and usually greater than the basis weight of said coated non-woven glass mat facing material (the first mat) before any coating is applied. Preferably, the basis weight of the second mat is at least about 0.5 pounds per 100 square feet, and more usually at least about 0.15 pounds per 100 square feet, greater than the pre-coated basis weight of said coated non-woven glass mat facing material (the first mat).

The second mat also has an uncompressed mat thickness in the range of about 25 to about 40 mils, with a thickness of about 33 mils being the most typical. As shown by the Example, a second mat made essentially of ¾ inch long K fibers having a basis weight of about 2.0 lb/100 ft.$^2$ has been shown to be suitable.

Non-woven mats suitable for use in the present invention typically will have an air permeability, prior to the application of any coating, of less than about 900 cfm (cubic feet per minute), and even more preferably less than about 800 cfm (measured using test method FG 436-910, which is incorporated herein by reference), but having an air permeability of at least about 100 cfm.

While the first and second mats have been described as being made from glass fibers, it is possible to include also a minor amount of synthetic fibers, such as polyester fibers, of similar dimensions as a replacement for some of the glass fibers in the mats. For example, 25 wt % of the glass fibers may be replaced with polyester fibers of a similar dimension. Glass mats having such a minor amount of synthetic fibers are considered glass mats within the meaning of the specification and claims. Mats made completely using glass fibers, i.e., an exclusively glass fiber mat, is preferred.

Following initial mat formation, an adhesive binder, preferably aqueous-based, is applied to the non-woven mat to create an integral structure. While urea-formaldehyde (UF) resins have commonly been used to make non-woven glass fiber mats, in order to realize the objectives of the present invention, an acrylic-type adhesive binder is required to be used on both of the first and second mats. The acrylic-based binder should constitute at least 50 wt. percent, preferably at least 75 wt. percent, more preferably at least 80 wt. percent and up to least 90 wt percent and most preferably the exclusive glass mat adhesive for each of the mats facing the two major surfaces of a gypsum board. The balance of the adhesive binder may be a urea-formaldehyde resin or a melamine-formaldehyde resin. However, for interior applications it often is desirable to minimize the potential for formaldehyde release or out-gassing from the mat. In that case the mat binder is almost exclusively made using an acrylic-type binder, i.e., only a small amount of a urea-formaldehyde resin may be used for crosslinking the acrylic-type binder Acrylic-type adhesive binders (or alternatively acrylic-type polymers) are polymers or co-polymers containing units of acrylic acid, methacrylic acid and their esters and related derivatives. Such polymers and copolymers can be either a thermosetting acrylic latex or a thermoplastic acrylic latex (also known as an elastomeric acrylic latex). Blends of both thermosetting and thermoplastic acrylic-type polymers, such as an equal weight blend of a thermoplastic and thermosetting polymer, can be used to advantage as the adhesive binder for the first and second mats. Such polymers and copolymers are well known and are widely available commercially. As a result, such polymers do not need to be described in detail. Such polymers and copolymers usually can be put into aqueous solution or are supplied as an aqueous latex emulsion.

For example, it is expected that suitable adhesives, and particularly the preferred aqueous-based latex adhesives, can be made by emulsion polymerization using the following monomers: (meth)acrylic acid (where the convention (meth) acrylic is intended to embrace both acrylic and methacrylic), 2-hydroxyethyl(meth)acrylate, 2-hydroxypropyl(meth)acrylate, 2-hydroxybutyl(meth)acrylate, methyl(meth)acrylate, ethyl(meth)acrylate, propyl(meth)acrylate, isopropyl(meth) acrylate, butyl(meth)acrylate, amyl(meth)acrylate, isobutyl (meth)acrylate, t-butyl(meth)acrylate, pentyl(meth)acrylate, isoamyl(meth)acrylate, hexyl(meth)acrylate, heptyl(meth) acrylate, octyl(meth)acrylate, isooctyl(meth)acrylate, 2-ethylhexyl(meth)acrylate, nonyl(meth)acrylate, decyl(meth) acrylate, isodecyl(meth)acrylate, undecyl(meth)acrylate, dodecyl(meth)acrylate, lauryl(meth)acrylate, octadecyl (meth)acrylate, stearyl(meth)acrylate, tetrahydrofuryl(meth) acrylate, butoxyethyl(meth)acrylate, ethoxydiethylene glycol (meth)acrylate, benzyl(meth)acrylate, cyclohexyl(meth) acrylate, phenoxyethyl(meth)acrylate, polyethylene glycol mono(meth)acrylate, polypropylene glycol mono(meth) acrylate, methoxyethylene glycol (meth)acrylate, ethoxyethoxyethyl(meth)acrylate, methoxypolyethylene glycol (meth)acrylate, methoxypolypropylene glycol (meth)acrylate, dicyclopentadiene(meth)acrylate, dicyclopentanyl (meth)acrylate, tricyclodecanyl(meth)acrylate, isobornyl (meth)acrylate, and bornyl(meth)acrylate. Other monomers which can be co-polymerized with the (meth)acrylic monomers, generally in a minor amount, include styrene, diacetone (meth)acrylamide, isobutoxymethyl(meth)acrylamide, N-vinylpyrrolidone, N-vinylcaprolactam, N,N-dimethyl(meth) acrylamide, t-octyl(meth)acrylamide, N,N-diethyl(meth) acrylamide, N,N'-dimethylaminopropyl(meth)acrylamide, (meth)acryloylmorphorine; vinyl ethers such as hydroxybutyl vinyl ether, lauryl vinyl ether, cetyl vinyl ether, and 2-ethylhexyl vinyl ether; maleic acid esters; fumaric acid esters; and similar compounds.

Acrylic-type polymers and copolymers particularly useful for making glass mats suitable for preparing the glass mat-faced gypsum board of the present invention are supplied as latex materials and in use have a glass transition temperature (GTT) of at least about 20° C., but not above about 115° C. Thus, acrylic-type polymers and copolymers having a glass transition temperature (GTT) of at least about 30° C., but not above about 85° C. would be especially suitable. Acrylic-type polymers and copolymers with a OTT of about 40° C. are particularly useful. While it is preferred that the same acrylic-type adhesive binder be used for both mats, as long as the glass transition temperature (GTT) of each acrylic-type adhesive binder is at least about 20° C., but not above about 115° C., the adhesive binders should have enough flexibility to allow the objectives of the present invention to be obtained.

One suitable acrylic-type polymer or copolymer available as a thermoplastic acrylic latex or elastomeric acrylic latex are the Rhoplex® polymers such as Rhoplex® GL-618, all available from the Rohm and Haas Company. Rhoplex® GL-618 has a GTT of about 36° C. Rohm & Hass TSet® acrylic latex polymers, which are thermosetting acrylic-type polymers also can be used, especially when blended, possibly at equal weights, with a thermoplastic or elastomeric acrylic latex. These thermosetting materials can be referred to also as formaldehyde-free polyacrylic thermosets. A suitable thermosetting acrylic latex may have a GLT of about 100° C.+.

The acrylic-type adhesive binder, preferably aqueous-based, can applied to the wet-laid, non-woven glass fiber mat using any suitable equipment, such as a curtain coater or a dip and squeeze applicator. In the drying and curing oven, the glass mat is heated to a temperature of up to about 250-300°

F., for a period of time not usually exceeding 1 or 2 minutes and frequently less than 30-50 seconds to dry and if needed, dry and if necessary cure the adhesive. The adhesive is applied in an amount sufficient to provide a integral, self-supporting mat. Suitable amounts are described in the aforementioned patents and in specific instances can be determined by routine testing.

Following formation of the non-woven glass fiber mats, the mat to be adhered to the major surface of the board facing the interior space of a room (i.e., the first mat) is provided on one side with a coating of a dried, preferably aqueous mixture of (i) a mineral (inorganic) pigment or filler, (ii) a polymer adhesive (organic) binder and optionally (iii) an inorganic adhesive binder. The other (second) mat is optionally provided with such a coating. Preferably, the coating is applied to the one side (surface) of the glass mat before using the mat to prepare the glass mat-faced gypsum board of the present invention. Typically, the coating is applied by contacting the mat with an aqueous mixture containing the recited constituents and then drying/curing the mixture.

On a dry weight basis of the two essential components (100%) of the mineral pigment and organic binder, the organic binder, usually a latex adhesive, and preferably an acrylic-type adhesive comprises at least about 1% and usually no more than about 20% and most often less than about 17% by weight of the coating, with the balance being the inorganic, mineral pigment or filler. Optionally, an inorganic binder preferably comprising at least about 0.5% by weight, of the total weight of the dried (cured) coating, but no more than about 20% by weight of the coating also can be present. The weight ratio of the mineral pigment or filler to the polymer adhesive (organic) binder can be in excess of 15:1 and in some cases can be in excess of 20:1, but usually is at least about 5:1.

Suitable coating compositions for making the coated mat thus may contain, on a dry weight basis of the three noted components (100%), about 75 to 99 percent mineral pigment or tiller, more usually about 80 to 95 percent mineral pigment or filler, about 0 to 20 percent inorganic adhesive, more usually about 0 to 10 percent and about 1 to 20 percent polymer adhesive (organic binder), usually about 1 to 17 percent and more usually about 1 to 12 percent.

As noted above, a mineral pigment or filler comprises the major component of the coating composition. Examples of mineral pigments suitable for making coated mats useful in the present invention include, but are not limited to, ground limestone (calcium carbonate), clay, sand, mica, talc, gypsum (calcium sulfate dihydrate), aluminum trihydrate (ATH), antimony oxide, or a combination of any two or more of these substances.

The mineral pigment is usually provided in a particulate form. To be an effective mineral pigment for making a coated mat for use as the first mat in this invention, the pigment preferably has a particle size such that at least about 95% of the pigment particles pass through a 100 mesh wire screen. Preferably, the pigment has most of, if not all of the fine particles removed. It has been observed that the presence of an excess amount of fine particles in the coating composition negatively impacts the porosity of the coated mat. A preferred mineral pigment is a limestone having an average particle size of about 40 microns. Such materials are collectively and individually referred to in the alternative as mineral pigments or as "fillers" throughout the remainder of this application.

The resin used in the coating also must satisfy a certain level of porosity when used in combination with the mineral filler in malting a coated glass mat. The porosity test is conducted with a coated test mat prepared by coating a glass mat with an aqueous coating formulation and drying it at 230° F. (110° C.) for 20 minutes. The coating formulation is prepared by combining the filler, the resin, usually a latex and preferably an acrylic-type latex, and any optional inorganic adhesive and blending thoroughly, such as for about 30 seconds. The aqueous formulation can be applied to the mat using a simple knife applicator to obtain a dry basis weight of about 22 grams of coating per sq. ft. on the glass mat.

The test for porosity following application and curing of the mat coating is a modification of the procedure of TAPPI T460, Gurley method for measuring the air resistance of paper. In this procedure, a sample of the coated mat (approximately 2 inches by 5 inches) is clamped between the 1 $in^2$ orifice plates of a Gurley Densometer, Model 4110. The inner cylinder is released and allowed to descend under only its own weight (i.e. by gravity alone) and the elapsed time (measured in seconds) between the instant the inner cylinder enters the outer cylinder of the apparatus until the 100 ml mark on the inner cylinder reaches (enters) the outer cylinder is recorded. The test then is repeated with the sample facing (oriented in) the opposite direction.

The porosity, reported in seconds, comprises the average of the two replicates for each sample. A suitable pre-coated glass fiber mat exhibits a porosity of less than about 45 seconds, preferably less than about 30 and more preferably less than about 20 seconds. At porosities of higher than about 45 seconds, the coated mat-gypsum core interface is at a much higher risk of delamination (i.e., blister formation) as the water vapors seek a path to escape during curing of the board. Preferably, the porosity is also more than about 2 seconds, so as to minimize bleedthrough of gypsum slurry during board manufacture.

Filler materials inherently containing some naturally occurring inorganic adhesive binder can be used to make the coated mat. Examples of such fillers, some listed with the naturally occurring binder, include (but are not limited to) the following: limestone containing quicklime (CaO), clay containing calcium silicate, sand containing calcium silicate, aluminum trihydrate containing aluminum hydroxide, cementitious fly ash and magnesium oxide containing either the sulfate or chloride of magnesium, or both. Depending on its level of hydration, gypsum can be both a mineral pigment and an inorganic adhesive binder, but it is only slightly soluble in water, and the solid form is crystalline making it brittle and weak as a binder. As a result, gypsum is not generally preferred for use as an inorganic adhesive binder.

Fillers, which inherently include an inorganic adhesive binder as a constituent and which cure by hydration, also advantageously act as flame suppressants. As examples, aluminum trihydrate (ATH), calcium sulfate (gypsum), and the oxychloride and oxysulfate of magnesium all carry molecules of water bound into their molecular structure. This water, referred to either as water of crystallization or water of hydration, is released upon sufficient heating, actually suppressing flames.

Low cost inorganic mineral pigments such with the properties of those described in the preceding paragraph, thus, may provide three (3) important contributions to the coating mixture: a filler; a binder; and, a fire suppressor.

Examples of polymer binders for use in coating compositions include, but are not limited to: styrene-butadiene-rubber (SBR), styrene-butadiene-styrene (SBS), ethylene-vinyl-chloride (EVCl), poly-vinylidene-chloride (PVdCl) and poly (vinylidene) copolymers, modified poly-vinyl-chloride (PVC), poly-vinyl-alcohol (PVOH), ethylene-vinyl-acetate (EVA), poly-vinyl-acetate (PVA) and polymers and copolymers containing units of acrylic acid, methacrylic acid, their esters and derivatives thereof (acryrlite-type polymers), such as styrene-acrylate copolymers. Most, if not all of these materials are available as latex formulations. Acrylic-type latex polymers are generally preferred.

In addition to the two essential components and the one optional component, the aqueous coating composition will also include water in an amount sufficient to provide the desired rheological properties (e.g., viscosity) to the composition, which is appropriate for the chosen form of application of the composition to and for retention on the surfaces of the glass fibers of the mat (including fibers within the interstices of the glass fiber mat), and other optional ingredients such as colorants (e.g., pigments), thickeners or rheological control agents, defoamers, dispersants and preservatives. Generally, the solids content of the aqueous coating formulation is between about 45% and 85% by weight. When used, the aggregate amount of such other ingredients in the coating composition is typically in the range of 0.1 to 5% and generally is not more than about 2% of the main, three noted components.

Any suitable method for applying an aqueous coating composition to the fibrous mat substrate can be used for making a coated mat, such as roller coating, curtain coating, knife coating, spray coating and the like, including combinations thereof. To achieve best properties in the coated mat and the resulting gypsum board, the coating is applied such that it penetrates into and envelopes the fibers of the glass fiber mat to a depth of from about 30 percent to about 50 percent of the thickness of the coated glass fiber mat. In this regard, reference is made to U.S. application Ser. No. 10/798,891 filed Mar. 12, 2004 and entitled Use of Pre-Coated Mat for Preparing Gypsum Board, which is incorporated herein by reference. Following application of the aqueous coating composition to the mat the composition is dried (cured), usually by heat to form the coated glass fiber mat.

In order for a pre-coated mat to be most useful in making the mat-faced gypsum board of this invention, it is preferred that the pre-coated mats be flexible enough to be rolled up into rolls of continuous sheet. As a result, pre-coated mats should not be so stiff and brittle that they will break upon bending. To accomplish this objective, it appears that the inorganic adhesive binder content of the mat coating generally should not exceed about 20% by weight of the total dry weight of the coating, and usually is less than 10%. Likewise, the polymer binder has practical upper limits, as noted earlier, due to cost and a desire to limit the combustibility of the coating.

The amount of coating applied to the surface of a fibrous mat normally should be sufficient to coat the surface of mat (i.e., the fibers constituting the surface of the mat) with the coating composition. In the case of the first mat, i.e., the mat intended to face the interior of a room, a sufficient coating is to be applied so that the surface of the mat is directly suitable for Level 4 finishing. The amount of coating required is dependent, in part, upon the thickness of the mat. It is difficult to measure the thickness of the coating because of the uneven nature of the fibrous mat substrate on which the coating is applied. In rough terms, the depth of the coating should be at least about 10 mils, but when the glass mat is relatively thin and the coating is efficiently dried, a coating as thin as 4 mils may suffice. In general, the depth or thickness of the coating need not exceed about 30 mils.

Coated glass fiber mats for use in this invention can be prepared by applying an aqueous coating composition containing the noted solid constituents to a fiber mat in an amount on a dry weight basis equivalent to at least about 15 lbs. per 1000 sq. ft, more usually between about 30 and 60 lbs., per 1000 sq. ft. of mat. Normally, the dry coating is present in an amount equivalent to at least about 40 lbs. per 1000 sq. ft., most often between about 35 and 55 lbs., per 1000 sq. ft. of mat, depending upon the thickness of the glass fiber mat. Although higher or lower amounts of coating can be used in any specific case, it is believed that, for most applications, the amount of coating will fall within the range of about 30 to about 60 lbs per 1000 sq. ft. of mat (dry basis).

Following application of the aqueous coating composition to the mat the composition is dried (cured), usually by heat to form a coated mat. A coated mat made in accordance with these teachings allows water vapor to pass through. One pre-coated mat suitable for use as the first mat in accordance with the present invention is prepared by coating a glass fiber mat with an aqueous coating composition containing an acrylic-type binder and a platelet-type clay filler. The glass fiber mat has a basis weight of about 1.8 lb./100 sq. ft. made solely with H fibers, 75% by weight of which are ¼inch in length and 25% by weight of which are ¾ inch in length, and bound together with a blend of an elastomeric acrylic latex, such as Rhoplex® GL-618 acrylic latex and a thermosetting acrylic latex, such as a Rohm & Haas TSet® acrylic latex, cross-linked with a small amount of U-F resin. The binder comprises about 20% by weight of the glass fiber mat before the coating is applied.

FIG. 1 is a cross section of a wallboard 10 made in accordance with the present invention. FIG. 1 is not intended to be to scale; various angles, thicknesses and other dimensions are exaggerated for clarity and purposes of illustrating the invention. Wallboard 10 has a gypsum board core 12. Wallboard 10 has a first major face 14, two edges 16, and a second major face 18. First major face 14 is covered over all (or substantially all) of its surface area with a coated non-woven glass mat 22 (first glass mat). Second major face 18 also is covered with a non-woven glass fiber mat 24 (second glass mat). As described below, the non-woven glass mat 22 is a pre-coated non-woven glass fiber mat, with the coating on the surface of the mat opposite the gypsum core (i.e., on the free surface of the mat).

In wallboard made for interior finishing applications, especially in residential dwellings, first major face 14 preferably has shaped regions 20 formed along marginal side portions of first major face 14 adjacent to edges 16. Although wallboard 10 is show with one specific taper configuration, alternate shapes including a square edge, a bevel, a rounded edge and other shapes (not shown), can be used. First major face 14 is covered over all (or substantially all) of its surface area with the coated glass fiber mat 22. Second major face 18 is covered with a glass fiber mat material 24. The mat material 24 may optionally also be a coated glass fiber mat, with the coating on the surface of the mat opposite the gypsum core (i.e., on the free surface). Mat material 24 overlies a portion of first mat 22, which wraps around the edges 16. Obviously, alternative ways of joining the mat facers together are possible.

Wallboard 10 can be made with varying thicknesses and different lengths and widths, as is well known, Typically, wallboards of two thicknesses are made, ½ inch and ⅝ inch, and generally are 4 feet wide and either 8 or 12 feet in length. For a ½ inch nominal thickness wallboard, an exemplary taper may have a width w of approximately 2.5 inches and a height h of approximately 0.075 inches.

The gypsum core 12 of wallboard 10 of the present invention is basically of the type used in gypsum structural products commonly known as paper-faced gypsum wallboard, dry wall, gypsum hoard, gypsum lath and gypsum sheathing. The present invention is not limited to any particular core composition. The core of such a gypsum product is formed by mixing water with powdered anhydrous calcium sulfate or calcium sulfate hemi-hydrate ($CaSO_4.½/H_2O$), also known as calcined gypsum to form an aqueous gypsum slurry, and thereafter allowing the slurry mixture to hydrate or set into calcium sulfate dihydrate ($CaSO_4.½H_2O$), a relatively hard material. The core of the product will in general comprise at least about 85 wt. percent of set gypsum, though the invention is not limited to any particular content of gypsum in the core.

The composition from which the set gypsum core of the structural panel is made can include a variety of optional additives, including, for example, those included conventionally in gypsum wallboard and well known to skilled workers. Again, the present invention is not limited to and does not exclude any of the known gypsum core additives. Examples of such additives include set accelerators, set retarders, foaming agents, reinforcing fibers, and dispersing agents. Fungicides can be added, if deemed desirable. To improve the water-resistant properties of the core, the gypsum composition from which the core is made may also include one or more additives to improve the ability of the set gypsum composition to resist being degraded by water (for example, to resist dissolution).

The wallboard may contain wax or a wax emulsion as an additive to improve the water resistance of the gypsum core. The invention is not limited thereby, however, and examples of other materials which have been reported as being effective for improving the water-resistant properties of gypsum products include the following: poly(vinyl alcohol), with or without a minor amount of poly(vinyl acetate); metallic resinates; wax or asphalt or mixtures thereof, usually supplied as an emulsion; a mixture of wax and/or asphalt and also cornflower and potassium permanganate; water insoluble thermoplastic organic materials such as petroleum and natural asphalt, coal tar, and thermoplastic synthetic resins such as poly(vinyl acetate), poly(vinyl chloride) and a copolymer of vinyl acetate and vinyl chloride and acrylic resins; a mixture of metal rosin soap, a water soluble alkaline earth metal salt, and residual fuel oil; a mixture of petroleum wax in the form of an emulsion and either residual fuel oil, pine tar or coal tar; a mixture comprising residual fuel oil and rosin; aromatic isocyanates and diisocyanates; organohydrogenpolysiloxanes, for example, of the type referred to in U.S. Pat. Nos. 3,455,710; 3,623,895; 4,136,687; 4,447,498; and 4,643,771, siliconates, such as available from Dow Corning as Dow Corning 772; a wax emulsion and a wax-asphalt emulsion each with or without such materials as potassium sulfate, alkali and alkaline earth aluminates, and Portland cement; a wax-asphalt emulsion prepared by adding to a blend of molten wax and asphalt an oil-soluble, water-dispersing emulsifying agent, and admixing the aforementioned with a solution of casein which contains, as a dispersing agent, an alkali sulfonate of a polyarylmethylene condensation product. Mixtures of these additives can also be employed. Within these classes of materials, poly(methylhydrogensiloxane) is particularly preferred. When used, the amount of the organopolysiloxane should be at least about 0.2 wt. %. As noted above, the use of any particular water-resistant additive is optional.

Typically, the core of non-woven glass fiber mat-faced gypsum wallboard has a density of about 40 to about 55 lbs. per cu. ft., more usually about 46 to about 50 lbs per cu. ft. Of course, cores having both higher and lower densities can be used in particular applications if desired. The manufacture of cores of predetermined densities can be accomplished by using known techniques, for example, by introducing an appropriate amount of foam (soap) into the aqueous gypsum slurry from which the core is formed or by molding.

In accordance with the present invention, and as illustrated in FIG. 1, one surface of the core 12 of the gypsum board 10 is faced with a non-woven glass fiber mat 22. The non-woven glass fiber mat is initially prepared and then pre-coated, as described above, to make it directly suitable for Level 4 finishing techniques. Coincidentally, the coating also may make the facer and the resulting board resistant to moisture. The coating is sufficiently porous to permit water in the aqueous gypsum slurry from which the gypsum core is made to evaporate in its vaporous state therethrough during manufacture of the board. The coated mat is prepared in advance and is used in fabricating board.

One surprising aspect of the present invention is that the first and second mats of the noted fibers bound together with an acrylic-type binder (nominal fiber diameter and fiber length, and preferred basis weights), one of which is coated and preferably both of which are coated, are able to provide a suitable level of porosity to enable the continuous preparation of a gypsum board by conventional commercial operation, without experiencing excessive delamination of the fibrous mat facer and without experiencing board warping, while yielding a finished board that has the surface characteristics (e.g., smoothness) making it directly suitable for Level 4 finishing techniques.

As described in more detail below, wallboard can be efficiently made by forming an aqueous gypsum slurry which contains excess water and placing the gypsum slurry onto a horizontally oriented moving web of the coated glass fiber mat. Another horizontally oriented moving glass fiber web (the second mat) is then placed on the upper free surface of the aqueous gypsum slurry. Following initial hydration and ultimately aided by heating, excess water evaporates through the mats as the calcined gypsum hydrates and sets.

Figure 2:
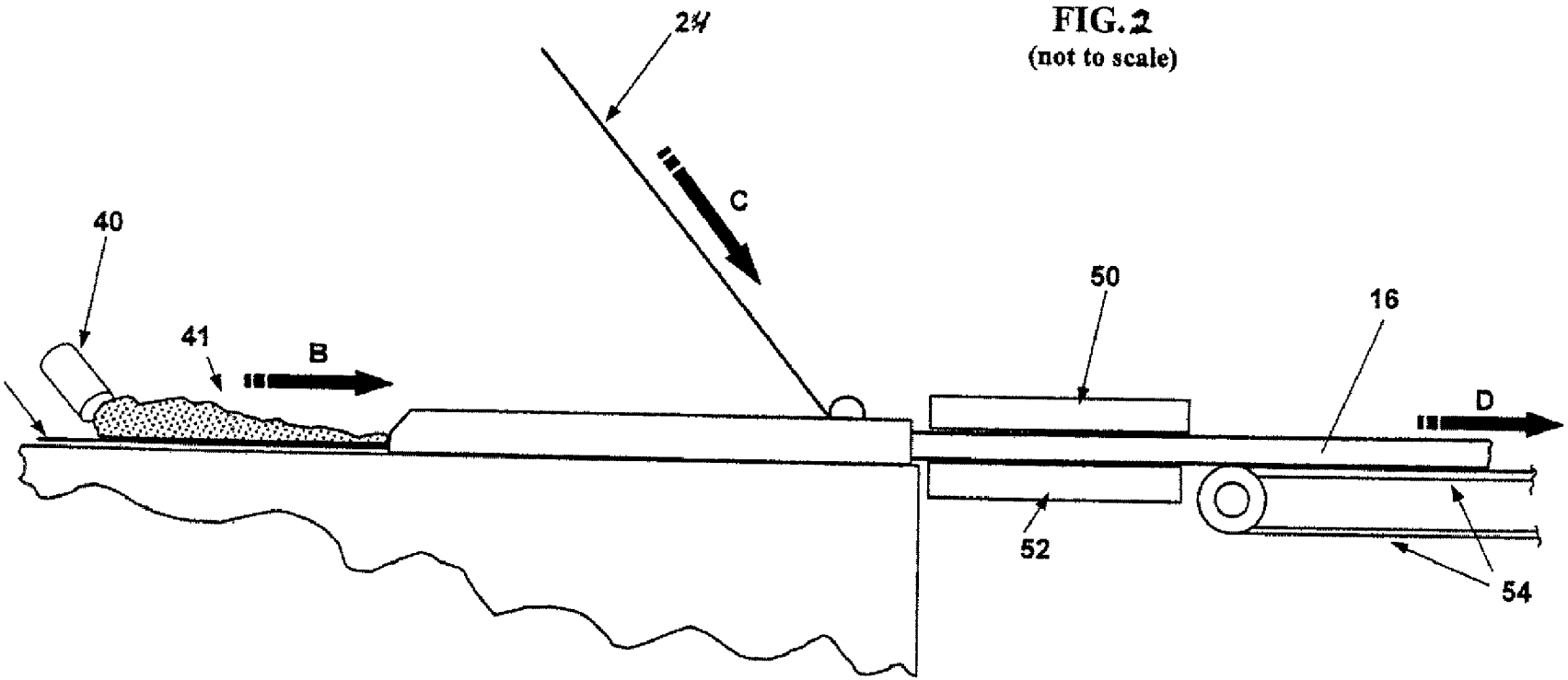
FIG. 2 is a highly schematic view of a portion of a wallboard production line.

FIG. 2 is a schematic drawing of a portion of a conventional manufacturing line for producing gypsum wallboard according to the present invention. In conventional fashion, dry ingredients from which the gypsum core is formed may be pre-mixed and then fed to a mixer of the type commonly referred to as a pin mixer (not shown). Water and other liquid constituents, such as soap, used in making the core are metered into the pin mixer where they are combined with the desired dry ingredients to form an aqueous gypsum slurry 41, which emerges from a discharge conduit(s) 40 of the pin mixer. Foam (soap) is generally added to the slurry, such as in the pin mixer, to control the density of the resulting core. Again, the method of making the core material for the gypsum board is not an essential part of the present invention and a wide variety of procedures can advantageously be used.

The slurry is deposited through one or more outlets of the discharge conduit 40 onto a horizontally moving continuous web of fibrous mat material 22 (the coated first glass mat). The amount deposited can be controlled in manners known in the art. Mat material 22 is fed from a roll (not shown) with the coated side down, i.e., away from the deposited gypsum slurry. Prior to receiving the sum slurry 41, the web of mat material 22 is flattened by rollers (not shown) and scored by one or more scoring devices (not shown). Scoring allows the sides of mat material 22 to be folded upward to form the edges of the board, as described below.

Mat material 22 (first mat) and the deposited gypsum slurry 41 move in the direction of arrow B. The moving web of mat 22 forms the first facing sheet of the wallboards being fabricated, and the slurry at least partially (and preferably, only partially) penetrates into the thickness of the mat and cures. On setting, a strong adherent bond is formed between the set gypsum and the glass fiber mat. The partial penetration of the slurry into the mat can be controlled according to methods known in the art such as, for example, controlling the viscosity of the slurry.

In conventional wallboard manufacture it also is known to apply a relatively thin coating of a higher density of the aqueous calcined gypsum slurry to the inside surface of either or both facers before applying the aqueous slurry of gypsum that forms the core. The facers with the thin gypsum slurry coating are then sandwiched together with the main core slurry to form a wet board. In a similar fashion, it also is known to apply a higher density of the aqueous calcined gypsum slurry along both edges (16 in FIG. 1) of the gypsum wallboard. These features can optionally be used in making gypsum wallboard in accordance with the present invention.

After the gypsum slurry 41 is deposited upon the web of mat material 22, the edges of that web are progressively folded (using equipment well-known to those skilled in the art) around the edges of the forming wallboard, and terminate on the upper surface of the slurry along the sides. The second glass fiber mat 22, fed in the direction of arrow C from a roll (not shown), is applied to the upper surface of the gypsum slurry 41, and usually only slightly overlaps the folded-around edges of the (bottom) web of first mat material 22.

Prior to applying the (top) second mat 24 to the upper surface of the gypsum slurry, glue may be applied to the second fibrous web along portions that will overlap and be in contact with the folded-over first mat edges (glue application is not shown). Although the invention is not limited by the type of glue used, preferably non-starch-based glues are used. One suitable glue is a poly(vinyl alcohol) latex glue. Glues based on vinyl acetate polymers, especially a vinyl acetate which has been hydrolyzed to form a polyvinyl alcohol, are widely available commercially as white glues. After the (top) web 24 is applied, the "sandwich" of glass fiber mat, gypsum slurry and glass fiber mat are pressed to the desired wallboard thickness between plates 50 and 52. Alternatively, the webs and slurry can be pressed to the desired thickness with rollers or in another manner. The continuous sandwich of slurry and applied facing materials then is carried by conveyor(s) 54 in the direction of arrow D. Slurry 41 sets as it is carried along.

Conventional methods for interior wallboard production form a shaped region at the edges of the bottom surface of the forming wallboard as it moves down the production line.

After being formed and after the gypsum has sufficiently set, the wallboard is typically cut to desired lengths and dried. To prevent the quality of the tapered edges from being degraded during drying, the board generally is turned over prior to drying.

Although not limited thereby, industrial driving conditions typically used in conventional continuous gypsum board manufacture also can be used in the manufacture of wallboard according to the present invention. Exemplary drying conditions include temperatures of about 200° to about 600° F., with drying times of about 30 to about 60 minutes, at line speeds of about 70 to about 600 linear feet per minute.

EXAMPLE

Nominal ⅝ inch gypsum wallboard (4'×12') was made on a conventional wallboard manufacturing line using a variety of glass mats as the first and second mats. The boards were made using the same gypsum core formulation throughout the trial in order to assess the impact of the different glass mat facer constructions on the properties of the resulting wallboard.

Six different first mat constructions were used throughout the trial, identified as Mats 1, 2, 3, 4, 5 and 6 in the attached Table 1. Mat 1 was made at a basis weight of 1.5 lbs/100 sq. ft. with only H fibers (10 to 11 micron nominal diameter) —25 wt. % of which were ¾ inch long and 75 wt. % of which were ¼ inch long and with an acrylic-type binder comprising a 50-50 by weight blend of an elastomeric acrylic latex and a thermosetting acrylic latex crosslinked with a small amount of a urea-formaldehyde resin. The acrylic resins were from Rohm & Haas. Mat 2 also was made at a basis weight of 1.5 lbs/100 sq. ft. with the same distribution of H fibers used for Mat 1 and with an elastomeric acrylic latex from Rohm & Haas with added melamine-formaldehyde resin (also a 50-50 blend). Mat 3 was made at a basis weight of 1.5 lbs/100 sq. ft. with 75 wt. % H fiber and 25 wt % K fiber (13 microns nominal diameter) and with a binder of the blend of an elastomeric acrylic latex from Rohm & Haas and added melamine-formaldehyde resin. The H fiber was ¼ inch in length while the K fiber was ¾ inch long. Mat 4 was made at a basis weight of 1.8 lbs/100 sq. ft. with 75 wt. % H fiber and 25 wt % K fiber and with a binder of the blend of an elastomeric acrylic latex from Rohm & Haas and added melamine-formaldehyde resin. Again, the H fiber was ¼ inch in length while the K fiber was ¾ inch long. Mat 5 was made at a basis weight of 1.8 lbs/100 sq. ft. with 75 wt. % H fiber and 25 wt % K fiber and with the 50-50 by weight blend of an elastomeric acrylic latex and a thermosetting acrylic latex from Rohm & Haas crosslinked with a small amount of a urea-formaldehyde resin. Once again, the H fiber was ¼ inch in length while the K fiber was ¾ inch long. Finally, Mat 6 was made at a basis weight of 1.8 lbs/100 sq. ft. with only H fibers—25 wt. % of which were ¾ inch long and 75 wt. % of which were ¼ inch long and with the blend of an elastomeric acrylic latex and a thermosetting acrylic latex.

All of the first mats were coated with the same coating formulation at approximately the same basis weight of coating.

Two different second mats were used in the trial. Both mats were made with ¾ inch K fibers bonded with the same acrylic-type binder. The binder was principally a 50:50 blend of an elastomeric acrylic latex and a thermosetting acrylic latex from Rohm & Haas. The second mat designated in Table 1 as Mat A was made at a basis weight of 1.4 lbs/100 sq. ft. The second mat designated in Table 1 as Mat B was made at a basis weight of 2.0 lbs/100 sq. ft. Both mats also were coated with the same coating formulation.

All told, gypsum boards were made with twelve different mat combinations. Table 1 reports the difference between the average of the flexural properties of five tested gypsum board samples of each of the twelve mat combinations that were produced and the qualifying standard; tested under four test conditions: Test I—first mat faced up with the board stressed in the cross-machine direction (qualifying standard=140); Test II—first mat faced down with the board stressed in the cross machine direction (qualifying standard=140); Test III—first mat faced up with the board stressed in the machine direction (qualifying standard=100) and Test IV—first mat faced down with the board stressed in the machine direction (qualifying standard=100) (Note: only four samples were tested in Tests I and II for the board of the Mat 5-Mat A combination). The boards were tested according to ASTM Standard 1178 using United tester method B.

The shaded boxes in Table 1 identify those instances where the average of the tested replicates satisfies the qualifying standard for the respective test. Of the tested combinations and as illustrated in Table 1, the only configurations to provide adequate results most consistently were the combinations Mat 4-Mat B, Mat 5-Mat B and Mat 6-Mat B. In the cases of Mat 2-Mat B and Mat 3-Mat B the size of the variance from standard observed in Test II signified an unacceptable consistency.

TABLE 1

| First Mat | Second Mat | Test I | Test II | Test III | Test IV |
|---|---|---|---|---|---|
| 1 | A | -31 | -21 | -16 | -14 |
| 2 | A | -29 | -24 | -7 | +9 |
| 3 | A | -46 | -29 | +6 | +16 |
| 4 | A | -23 | -4 | -21 | +28 |
| 5 | A | -16 | +2 | -14 | +30 |
| 6 | A | -35 | +2 | -16 | +11 |
| 1 | B | -9 | -17 | +6 | -9 |
| 2 | B | +9 | -28 | +11 | +15 |
| 3 | B | +2 | -16 | -2 | 0 |
| 4 | B | +17 | -3 | +22 | +32 |
| 5 | B | +16 | -3 | +14 | +32 |
| 6 | B | +5 | +17 | -1 | +15 |

It will be understood that while the invention has been described in conjunction with specific embodiments thereof, the foregoing description and examples are intended to illustrate, but not limit the scope of the invention. Other aspects advantages and modifications will be apparent to those skilled in the art to which the invention pertains, and these aspects and modifications are within the scope of the invention, which is limited only by the appended claims. Unless otherwise specifically indicated, all percentages are by weight. Throughout the specification and in the claims the term "about" is intended to encompass + or −5%.

The invention claimed is:

1. A gypsum wallboard comprising:

a gypsum core having a planar first major face and a planar second major face;

a first coated non-woven mat facing material comprising glass fiber and an adhesive polymer binder, the first coated non-woven mat facing material adhered on a non-coated side to the planar first major face of the gypsum core, wherein the first coated non-woven mat has a first basis weight before application of the coating;

a second non-woven mat facing material comprising glass fiber wherein the second non-woven mat facing material is optionally coated with an adhesive polymer binder, the second coated non-woven mat facing material adhered on a non-coated side to the planar second major face of the gypsum core, wherein the second non-woven mat has a second basis weight before application of the optional coating, and wherein the second basis weight is greater than the first basis weight.

2. The gypsum wallboard of claim 1, wherein the second basis weight is at least about 0.15 pounds per 100 square feet greater than the first basis weight.

3. The gypsum wallboard of claim 1, wherein the second basis weight is at least about 0.5 pounds per 100 square feet greater than the first basis weight.

4. The gypsum wallboard of claim 1, wherein the adhesive polymer binder of one or both of the first and second coated non-woven mat facing material comprises styrene-butadiene rubber, styrene-butadiene-styrene, ethylene-vinyl chloride, polyvinylidene chloride, polyvinyl alcohol, ethyene-vinyl acetate, polyvinyl acetate, a homopolymer or polymer comprising (meth)acrylic acid units, a homopolymer or copolymer comprising (meth)acrylic acid ester units, or a combination thereof.

5. The gypsum wallboard of claim 1, wherein the adhesive polymer binder of one or both of the first and second coated non-woven mat facing material comprises styrene-butadiene rubber, styrene-butadiene-styrene, ethylene-vinyl chloride, polyvinylidene chloride, polyvinyl alcohol, ethyene-vinyl acetate, polyvinyl acetate, or a combination thereof.

6. The gypsum wallboard of claim 1, wherein the adhesive polymer binder of one or both of the first and second coated non-woven mat facing material is the same.

7. The gypsum wallboard of claim 1, wherein the adhesive polymer binder of one or both of the first and second coated non-woven mat facing material comprises an acrylic-type binder, wherein the acrylic-type binder is a homopolymer or copolymer comprising (meth)acrylic acid units, a homopolymer or copolymer comprising (meth)acrylic acid ester units, or a combination thereof.

8. The gypsum wallboard of claim 7, wherein the adhesive polymer binder of the first and second coated non-woven mat facing material is the same.

9. The gypsum wallboard of claim 7, wherein the adhesive polymer binder of the first and second coated non-woven mat facing material is the same, and each has a Tg in use of about 20° C. to about 115° C.

10. The gypsum wallboard of claim 7, wherein the adhesive polymer binder of one or both of the first and second coated non-woven mat facing material comprises a homopolymer or polymer comprising units derived from (meth)acrylic acid, 2-hydroxyethyl(meth)acrylate, 2-hydroxypropyl(meth) acrylate, 2-hydroxybutyl(meth)acrylate, methyl(meth)acrylate, ethyl(meth) acrylate, propyl(meth)acrylate, isopropyl (meth)acrylate, butyl(meth) acrylate, amyl(meth)acrylate, isobutyl(meth)acrylate, t-butyl(meth) acrylate, pentyl(meth) acrylate, isoamyl(meth)acrylate, hexyl(meth) acrylate, heptyl(meth)acrylate octyl(meth)acrylate, isooctyl(meth) acrylate 2-ethylhexyl(meth)acrylate, nonyl(meth)acrylate, decyl (meth) acrylate, isodecyl(meth)acrylate, undecyl(meth) acrylate, dodecyl(meth) acrylate, lauryl(meth)acrylate, octadecyl(meth)acrylate, stearyl(meth) acrylate, tetrahydrofurfuryl(meth)acrylate, butoxyethyl(meth)acrylate, ethoxydiethylene glycol (meth)acrylate, benzyl(meth)acrylate, cyclohexyl(meth)acrylate, phenoxyethyl(meth)acrylate, polyethylene glycol mono(meth)acrylate, polypropylene glycol mono(meth)acrylate, methoxyethylene glycol (meth) acrylate, ethoxyethoxyethyl(meth)acrylate, methoxypolyethylene glycol (meth)acrylate, methoxypolypropylene glycol (meth)acrylate, dicyclopentadiene(meth)acrylate, dicyclopentanyl(meth) acrylate, tricyclodecanyl(meth)acrylate, isobornyl(meth)acrylate, bornyl(meth)acrylate, or a combination thereof.

11. The gypsum wallboard of claim 10, wherein the adhesive polymer binder of one or both of the first and second coated non-woven mat facing material is a copolymer further comprising styrene, diacetone(meth)acrylamide, isobutoxymethyl(meth)acrylamide, N-vinylpyrrolidone, N-vinylcaprolactam, N,N-dimethyl(meth)acrylamide, t-octyl(meth) acrylamide, N,N-diethyl(meth)acrylamide, N,N'-dimethylaminopropyl(meth)acrylamide, (meth)acryloylmorphorine, a vinyl ether, a maleic acid ester, a fumaric acid ester, or a combination thereof.

12. The gypsum wallboard of claim 11, wherein the vinyl ether is vinyl ether, lauryl vinyl ether, cetyl vinyl ether, 2-ethylhexyl vinyl ether, or a combination thereof.

13. The gypsum wallboard of claim 7, wherein the adhesive binder of one or both of each of the first and second coated non-woven mat facing material further comprises a urea-formaldehyde resin or a melamine-formaldehyde resin.

14. The gypsum wallboard of claim 1, wherein the adhesive binder of one or both of each of the first and second coated non-woven mat facing material comprises at least 50 weight percent acrylic-type binder.

15. The gypsum wallboard of claim 14, wherein the adhesive binder of one or both of each of the first and second coated non-woven mat facing material further comprises a urea-formaldehyde resin or a melamine-formaldehyde resin.

16. The gypsum wallboard of claim 7, wherein the adhesive binder of each of the first and second coated non-woven mat facing material comprises at least 80 weight percent acrylic-type binder.

17. The gypsum wallboard of claim 16, wherein the adhesive binder of one or both of each of the first and second coated non-woven mat facing material further comprises a urea-formaldehyde resin or a melamine-formaldehyde resin.

18. The gypsum wallboard of claim 1, wherein the second non-woven mat facing material comprises glass fibers of a larger diameter and of a longer length than the glass fibers of the first coated non-woven mat facing material.

19. The gypsum wallboard of claim 1, wherein the coating of one or both of each of the first and second coated non-woven mat facing material further comprises a mineral pigment.

* * * * *